United States Patent [19]

Murphy et al.

[11] Patent Number: 4,516,914

[45] Date of Patent: May 14, 1985

[54] MICRO-PROCESSOR CONTROL OF MOVEABLE SLIDE STOP AND A MOVEABLE SLIDE VALVE IN A HELICAL SCREW ROTARY COMPRESSOR

[75] Inventors: David A. Murphy, Chambersburg, Pa.; Peter C. Spellar, Hagerstown, Md.

[73] Assignee: Frick Company, Waynesboro, Pa.

[21] Appl. No.: 659,038

[22] Filed: Oct. 10, 1984

Related U.S. Application Data

[63] Continuation of Ser. No. 416,768, Sep. 10, 1982, abandoned.

[51] Int. Cl.[3] ..... F01C 1/16; F04B 49/06

[52] U.S. Cl. ..... 417/282; 417/310; 418/201

[58] Field of Search ..... 418/201; 417/280, 282, 417/310, 45

[56] References Cited

U.S. PATENT DOCUMENTS

| | | | |
|---|---|---|---|
| Re. 29,283 | 6/1977 | Shaw | 417/282 |
| 2,519,913 | 8/1950 | Lysholm . | |
| 3,088,659 | 5/1963 | Nilsson et al. . | |
| 3,151,806 | 10/1964 | Whitfield . | |
| 3,314,597 | 4/1965 | Schibbye . | |
| 3,527,548 | 9/1970 | Kocher et al. . | |
| 3,924,972 | 12/1975 | Szymaszek | 417/310 |
| 4,080,110 | 3/1978 | Szymaszek | 417/280 |
| 4,222,716 | 9/1980 | Shaw | 417/310 |
| 4,249,866 | 2/1981 | Shaw et al. | 417/280 |

OTHER PUBLICATIONS

Drawing, "SRM", Svenska-Rotor Maskiner AB, Feb. 18, 1981.

*Primary Examiner*—Richard E. Gluck

*Attorney, Agent, or Firm*—Dowell & Dowell

[57] ABSTRACT

An axial flow helical screw type compressor has a slide valve member and a slide stop member mounted end to end beneath the intermeshing rotors such that the slide valve member controls communication between the work chamber defined by the rotors and the casing to the outlet port and the slide stop member and the valve member together control the working fluid inlet to the bores of the rotors, the slide valve member and the slide stop being independently movable. Control means for the slide valve member and slide stop include position sensing means for these two members, inlet and outlet pressure sensing means, and means for feeding these inputs into programmable circuitry to control the positions of the slide member and slide stop.

10 Claims, 4 Drawing Figures

OIL FROM LUBRICATION SYSTEM
POT. 1
POT. 2
P T
A B

MICRO-PROCESSOR CONTROL OF MOVEABLE SLIDE STOP AND A MOVEABLE SLIDE VALVE IN A HELICAL SCREW ROTARY COMPRESSOR

This application is a continuation of application Ser. No. 416,768, filed 9/10/82, now abandoned.

FIELD OF THE INVENTION

This invention relates to helical screw type compressors with axial fluid flow in which means is provided for matching the internal compression ratio in the compressor to the inlet and outlet compression ratio and simultaneously controlling the capacity of the compressor.

DESCRIPTION OF THE PRIOR ART

Axial flow helical screw type compressors with means for substantially equalizing the pressure of fluid being discharged with that of the fluid in the discharge area have been described in patents including Lysholm U.S. Pat. Nos. 2,519,913, Whitfield 3,151,806, and Shaw Re. 29,283.

Axially shiftable slide valves for adjusting the capacity of a screw compressor are disclosed in Schibbye U.S. Pat. Nos. 3,314,597, and Kocher et al. 3,527,548.

The patent to Shaw U.S. Pat. No. 4,222,716 discloses a helical screw rotary compressor having a slide valve member for controlling the outlet port and a shiftable cylindrical valve member within the slide valve member for varying the volumetric capacity.

Shaw U.S. Pat. No. Re. 29,283 discloses a compressor having a capacity control slide valve member above the rotors and an under compression/over compression control slide under the rotors.

Shaw U.S. Pat. No. 4,249,866 discloses a compressor with a slide valve member and condition responsiveness means for controlling its position.

Szymaszek U.S. Pat. Nos. 3,924,972 and 4,080,110 disclose compressor slide valve members whose position is controlled in response to a network including condition sensing and slide position or other parameter sensing.

SUMMARY OF THE INVENTION

The present invention is directed to control means for matching the internal compression ratio in the compressor to the inlet and outlet compression ratio and simultaneously controlling the capacity of the compressor. This is accomplished by mounting two slides on the same axis beneath the rotors, the combined effective length of which exceeds that of the rotors. This permits the end of one slide in the discharge area to be positioned to govern the compression ratio and for the space between the two slides to be varied in order to provide the desired capacity. The physical position of each slide is monitored as are the inlet and outlet pressures and these four items are fed into an electrical network including a computer which is programmed to control the positions of the slides in accordance with the program.

Figures 1, 2, 3:
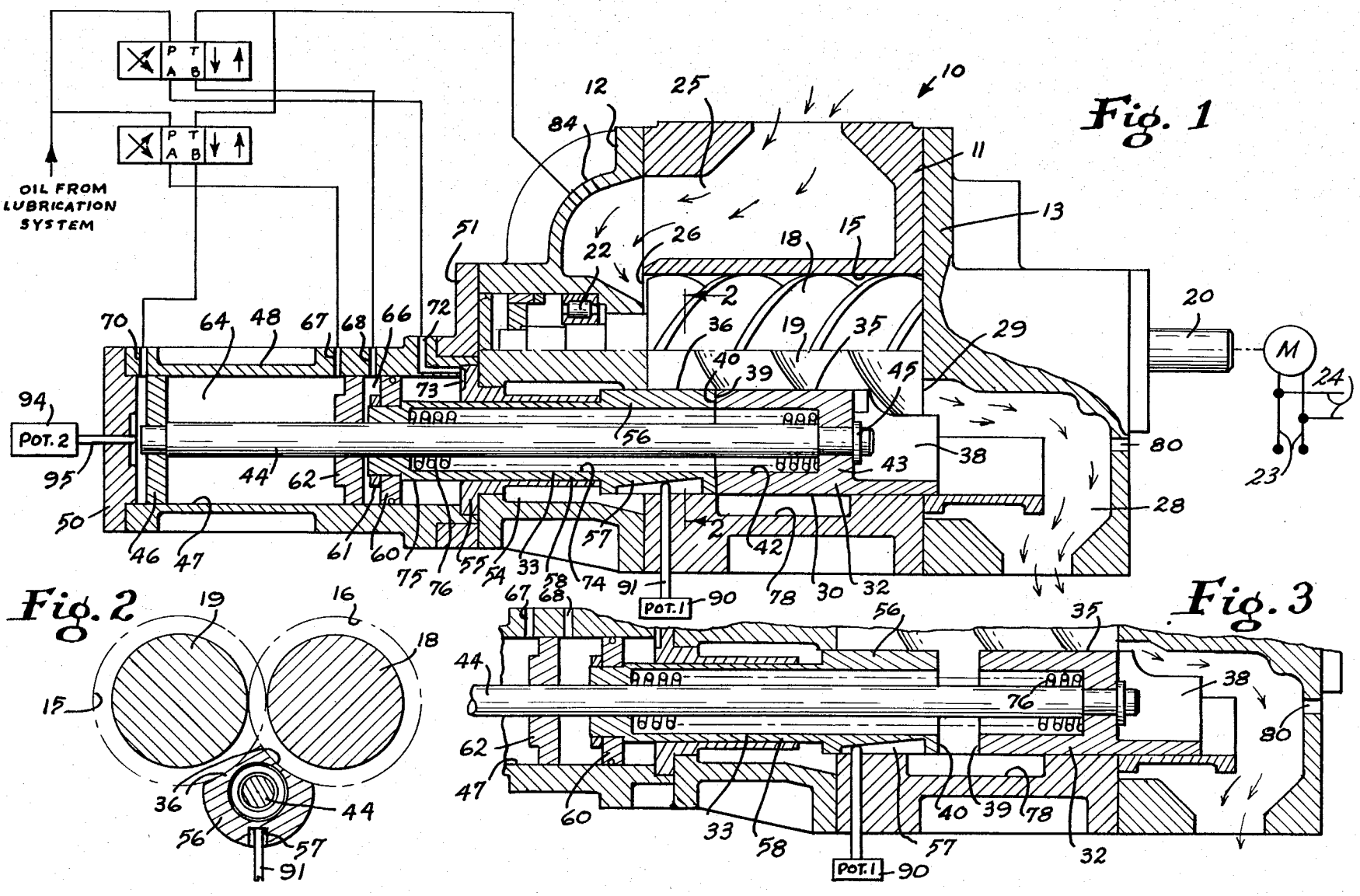
FIG. 1 is a horizontal sectional view of a screw type compressor in accordance with the present invention with portions broken away for clarity.
FIG. 2 is a sectional view of a portion of the compressor taken on the line 2—2 of FIG. 1.
FIG. 3 is a view similar to FIG. 1 illustrating the slide valve and slide stop in positions differing from those of FIG. 1.
Figure 4:
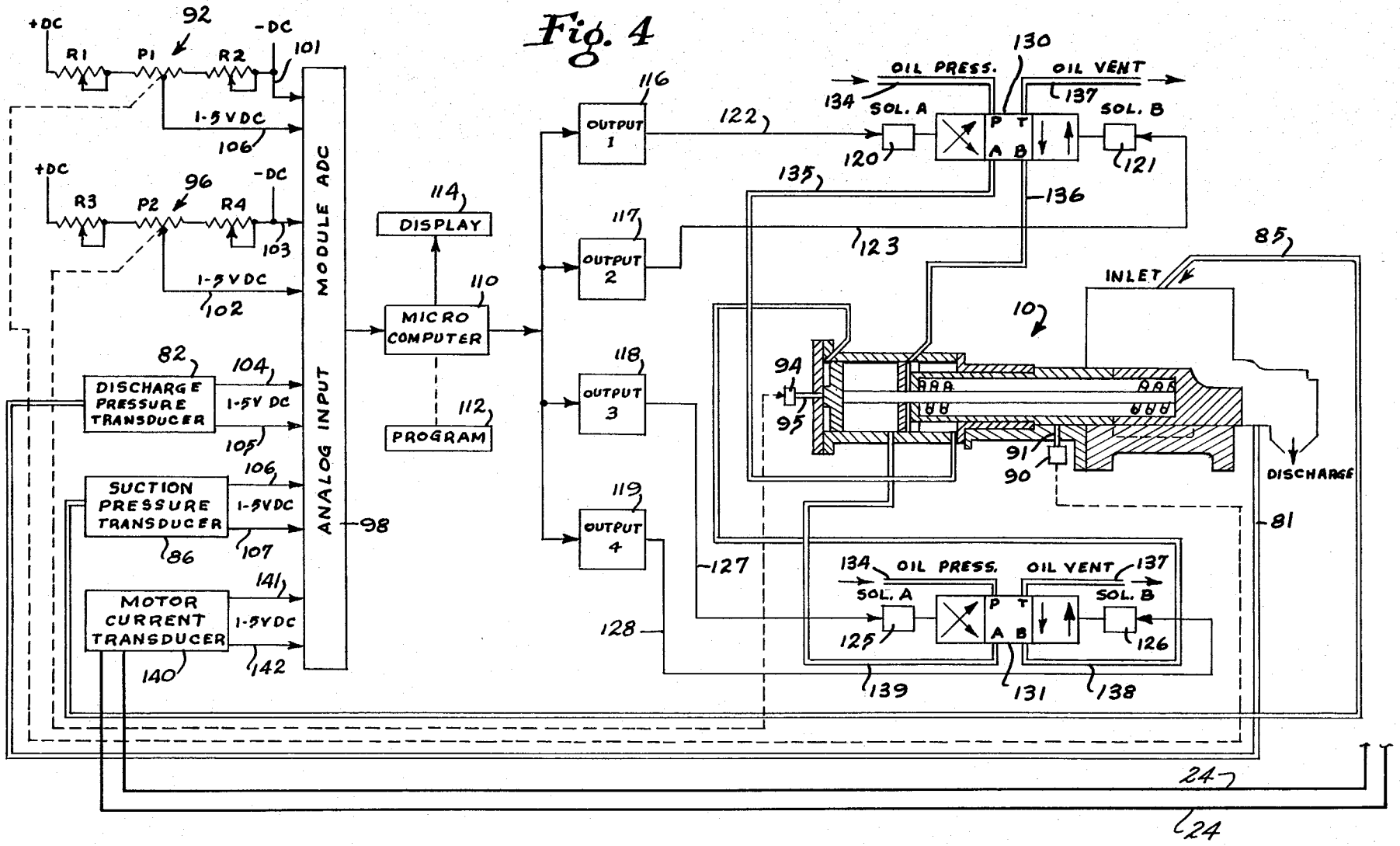
FIG. 4 is a schematic view including the control circuitry.

With further reference to the drawings a helical screw compressor 10 is illustrated having a central rotor casing 11, an inlet casing 12, and an outlet casing 13 connected together in sealing relationship. The rotor casing has intersecting bores 15 and 16 providing a working space for intermeshing male and female helical rotors or screws 18 and 19 mounted for rotation about their parallel axes by suitable bearings.

Rotor 18 is mounted for rotation on shaft 20 carried in a bearing (not shown) in outlet casing 13, and in bearing 22 carried in inlet casing 12. Shaft 20 extends outwardly from the outlet casing for connection to a motor through a suitable coupling (not shown). The motor may be powered electrically through leads 23, the current of which is sensed through conductors 24 for purposes which will be described.

The compressor has an inlet passageway 25 in inlet casing 12 communicating with the working space by port 26. A discharge passageway 28 in outlet casing 13 communicates with the working space by port 29 (which is at least partially within the outlet casing 13).

It will be apparent in the illustrated embodiment that in a horizontally positioned machine inlet port 26 lies primarily above a horizontal plane passing through the axes of the rotors and outlet port 29 lies primarily below such plane.

Positioned centrally beneath the bores 15 and 16, and having a parallel axis, is a longitudinally extending, cylindrical recess 30 which communicates with both the inlet and outlet ports.

Mounted for slideable movement in recess 30 is a compound valve member including a slide valve 32 and cooperating member or slide stop 33. The innerface 35 of the slide valve, and the innerface 36 of the slide stop are in confronting relation with the outer peripheries of the rotors 18 and 19 within the rotor casing 11.

The right end of the slide valve (as viewed in FIG. 1) has an open portion 38 on its upper side providing a radial port communicating with the outlet port 29. The left end 39 may be flat or shaped as desired to fit against the right end 40 of the slide stop in order that engagement of the two adjacent ends of the slide valve and slide stop will seal the recess 30 from the bores 15 and 16.

The slide valve has an inner bore 42 and a head 43 at one end. A rod 44 is connected by fastening means 45 at one end to the head through which it extends and at its other end to a piston 46. The piston is mounted to reciprocate in the barrel 47 of cylinder 48 which is connected to and extends axially from the inlet casing 12. A cover or end plate 50 is mounted over the outer end of the cylinder 48. The inlet casing 12 is connected to the cylinder 48 by an inlet cover 51 which receives a reduced diameter end portion 52 of cylinder 48.

Mounted interiorly of the inlet cover 51 is a sleeve 54 having a bulkhead portion 55 at one end and extending longitudinally towards the rotor casing. The slide stop 33 has a head portion 56 terminating in the end 40 and the head portion having an inclined slot 57 on its underside sloping upwardly from left to right as viewed in the drawing. The axial length of the slot is adequate to permit the maximum desired movement of the slide stop. From the head portion the slide stop has a main portion 58 which is slideably received within the sleeve 54. At its other end the slide stop has a piston 60 secured by suitable fastening means 61.

A stationary bulkhead 62 is fixed in the cylinder 48 intermediate its ends and separates the interior into an outer compartment 64 in which piston 46 moves, and an inner compartment 66 in which piston 60 moves. Cylinder 48 has fluid ports 67 and 68 closely adjacent each side of the bulkhead 62 communicating with the compartments 64 and 66, respectively. At the outer end of cylinder 48 a fluid port 70 is provided in communication with the compartment 64 but on the opposite side of piston 46. At its inner end the cylinder 48 has port 72 communicating with recess 73 in the outer end face of the bulkhead portion 55 of the sleeve 54 for introducing and removing fluid from the compartment 66 but on the opposite side of piston 60 from the port 68.

The slide stop has an inner bore 74 of matching diameter to that of bore 42 in the slide valve 32 and communicating with that bore. At its other end the slide stop has a head 75 which mounts the piston 60.

A self-unloading coil spring 76 is positioned in the coaxial bores 74 and 42, around rod 44, and tends to urge the slide valve 32 to closed position and to urge the slide stop into abutting relation with the bulkhead 62. In such position the slide valve and slide stop are spaced apart a maximum distance.

In operation the working fluid, such as a refrigerant gas enters the compressor by inlet 25 and port 26 into the grooves of the rotors 18 and 19. Rotation of the rotors forms chevron shaped compression chambers which receive the gas and which progressively diminish in volume as the compression chambers move toward the inner face of the outlet casing 13. The fluid is discharged when the crests of the rotor lands defining the leading edge of a compression chamber pass the edge of port 38 which communicates with the discharge 28. Positioning of the slide valve 32 away from the outlet casing 13 reduces the compression ratio by enlarging the final compression chamber. Positioning towards the outlet casing as indicated in FIG. 3, has the opposite effect. Thus, movement of the slide valve varies the compression ratio and the pressure of the gas discharged from the compressor.

The compressor is constructed to provide a controlled variation in its volumetric capacity simultaneously with controlling its compression ratio. Thus, as will be described, the slide valve and slide stop may be controlled to match the internal compression ratio in the compressor to the inlet and outlet compression ratio as the volumetric capacity is controlled. When the slide valve and slide stop are moved apart, as indicated in FIG. 3, the space therebetween communicates with the intermeshed rotors 18 and 19 to permit working fluid in a compression chamber between the rotors at inlet pressure to remain in communication with the inlet through slot 78 and a passageway (not shown) in casing 11 thereby decreasing the volume of fluid which is compressed. Thus, maximum capacity is provided with the slide valve and slide stop in abutting relation. The nearer the outlet casing the space between the slide valve and the slide stop is positioned, the greater the decrease in capacity from a maximum.

The Control System

The present invention includes a control system for moving the slide valve and slide stop in accordance with a predetermined program to accomplish the aforestated objectives. In order to do this four variables from the compressor are constantly sensed and fed into an electrical network. Thus, outlet casing 13 has a plug opening 80 connected by conduit 81 to discharge pressure transducer 82. Inlet casing 12 has plug opening 84 connected by conduit 85 to suction pressure transducer 86. Potentiometer 90 has its movable element 91 extending through the wall of rotor casing 11 and engaged with the inclined slot 57 in the slide stop 33 and fuctioning as P1 to control voltage divider network 92. Potentiometer 94 has its movable element 95 extending through the cylinder cover 50 into engagement with rod 44 of slide valve 32 and functioning as P2 to control voltage divider network 96. The voltage divider network 92 includes calibration resistors R1 and R2 and transmits a 1–5 voltage DC signal to the analog input module 98 by lines 100 and 101. Similarly, voltage divider network 96 includes calibration resistors R3 and R4 and feeds a 1–5 DC signal to the analog input module 98 by lines 102 and 103.

The discharge pressure transducer 82 and suction pressure transducer 86 convert the signal each receives to a 1–5 volt DC signal and sends it by lines 104–107 to analog input module 98.

Module 98 converts the signals it receives to digital signals and transmits these to microcomputer 110. Microcomputer 110 has a program 112 of predetermined nature so that the computer output provides the desired control of the slide valve 32 and slide stop 33. An appropriate readout or display 114 is connected to the computer 110 to indicate the positions of the slide valve and the slide stop based on the signals received from the feedback potentiometers 90 and 94.

From the computer 110, four control signals are provided through the outputs 116, 117, 118 and 119. Thus, the two signals from the voltage divider networks 92 and 96, responsive to slide stop and slide valve position, and the two signals from the discharge and suction pressure transducers 82 and 86, are coupled through the analog input to the microcomputer and processed thereby to deliver appropriate outputs 116 through 119. Outputs 116 and 117 are connected to solenoids 120 and 121 through lines 122 and 123, respectively. Outputs 118 and 119 are connected to solenoids 125 and 126 through lines 127 and 128, respectively.

Solenoids 120 and 121 control hydraulic circuits through control valve 130 which position the slide stop 33. Solenoids 125 and 126 control hydraulic currents through control valve 131 which position the slide valve 32.

Control valve 130 is connected by line 134 to a source of oil or other suitable liquid under pressure from the pressurized lubrication system of the compressor. Line 135 connects the valve 130 to fluid port 72 and line 136 connects the valve to fluid port 68. A vent line 137 is connected to the inlet area of the compressor.

Control valve 131 is connected by line 134 to the oil pressure source and by line 137 to the vent. Line 138 connects valve 131 to fluid port 67 and line 139 connects valve 131 to fluid port 70.

In operation, energizing solenoid 120 of valve 130 positions the valve so that flow is in accordance with the schematic representation on the left side of the valve, the flow being from "P" to "B" and thus applying oil pressure via conduit 136 against the left side of piston 60 and simultaneously venting oil from the opposite side of the piston via conduit 135 and in the valve from "A" to "T" to the oil vent. This urges the piston and its associated slide stop to the right, as represented in the drawing.

Energizing solenoid 121 of valve 130 positions the valve so that flow is in accordance with the schematic representation on the right side of the valve, the flow being from "P" to "A" and thus applying oil pressure via conduit 135 against the right side of piston 60 to urge it to the left and simultaneously venting oil from the opposite side of the piston via conduit 136 and in the valve from "B" to "T" to the oil vent.

Similarly, energizing solenoid 125 of valve 131 positions that valve from "P" to "B" to apply pressure through fluid port 70 and venting through fluid port 67 from "A" to "T" to move the slide valve to the right as represented in the drawing. Energizing solenoid 126 of valve 131 positions the valve from "P" to "A" to apply pressure through fluid port 67 and venting through fluid port 70 from "B" to "T" to move the slide valve to the left.

When the compressor is used in a refrigeration system it is normally desired to move its slide valve to maintain a certain suction pressure which is commonly referred to as the "set point". Optionally, other parameters such as the temperature of the product being processed in a refrigeration system associated with the compressor, may be used as factors affecting the position of the slide valve and, hence, the capacity of the compressor. The system of the present invention contemplates entering a desired set point into the microcomputer 110 by appropriate switches connected with a control panel, not shown, associated with the display 114. The control panel may also include provision for controlling the mode of operation, e.g., automatic or manual, and the operation of the slide stop, slide valve, and compressor. The readout display 114 from the microcomputer 110 is based on the signals it receives. The necessary electrical connections are made between the control panel and the microcomputer 110 in order to accomplish the desired function by means well known in the art.

The program associated with the microcomputer 110 is such that it will select the proper position for the slide stop 33 based upon the information received from the discharge pressure transducer 82 and the suction pressure transducer 86, and the characteristics of the refrigerant and the compressor. The program is prepared so that it will control the position of the slide valve 32 based upon the suction pressure transducer 86 or other appropriate capacity indication.

Thus, the control system contemplates constantly sensing the four variables, discharge and suction pressure, and the positions of the slide stop and slide valve, and, if necessary, moving the slide stop and slide valve in the appropriate direction until the signals received by the microcomputer 110 are in balance with the position of the slide stop established by the program 112 and the slide valve.

In order to avoid excessive current to the motor driving the compressor, in systems using an electric motor, a motor current transducer 140 is connected to such motor, M, by the conductors 24. The transducer 140 is connected by lines 141 and 142 to the analog input module 98, connected to the microcomputer 110. Microcomputer 110 is so programmed that it will not permit the slide valve 32 to load the compressor to the point that the motor current exceeds a predetermined limit, and will unload the slide valve 32 if the motor current exceeds such limit.

The slide valve 32 operates as a floating type of control. It is moved in the direction of loading or unloading in response to a capacity control signal, e.g., derived from the suction pressure transducer 86, but it is not positioned to any precise location relative to any other signal or control. While the capacity control signal is usually based on the suction pressure, it may include other parameters such as the product temperature, as stated above. The outputs from loading and unloading are normally pulsed in a time proportioned arrangement to vary the rate of response of the slide valve with the magnitude of the error of the capacity control signal.

The signal from the potentiometer 90 associated with the slide valve is not used to control its position. However, it is used to indicate its position and such position is used for other purposes including starting the compressor fully unloaded, and where applicable, in multicompressor sequencing.

In contrast the slide stop is controlled to a precise location, as stated above. The feedback from its potentiometer 94 is used to determine when it is in the desired position.

The feedbacks from the potentiometers for both the slide stop and slide valve are used to determine whether a conflict or overlapping exists between the desired mechanical position of the slide stop and the actual mechanical position of the slide valve. If a conflict exists, the slide valve is temporarily relocated so that the positioning of the slide stop takes precedence.

The system also has provision whereby appropriate controls indicated on the control panel may be operated to permit manual positioning of both the slide valve and the slide stop.

It will be understood by those skilled in the art that positioning of the slide valve and slide stop with reference to the rotor casing and to each other permits the desired variations in the compression ratio so that the compressor may be "loaded" or "unloaded" as required by various parameters.

While hydraulic means has been described for moving the slide stop and slide valve, it is obvious that other means well known to those skilled in the art may be used. For example, electric stepper motors or stepper motor piloted hydraulic means may be used if desired.

We claim:

1. In a screw compressor having meshing helical rotors on parallel axes and mounted in a housing having intersecting cylindrical bores, a high pressure end wall at one end of said housing and a low pressure end wall at the other end thereof, the low pressure end wall having an inlet opening for the inlet of the compressor and the high pressure end wall having a discharge opening for the outlet of the compressor, an axially extending recess in the housing in open communication with said bores, a slide valve member mounted for axial movement in the recess, said slide valve member having an inner face in sealing relationship with said rotors, said slide valve member having a discharge face at one end thereof which is adjacent to the high pressure end wall and having a rear face at its other end, and a slide stop member mounted for axial movement in said recess, said slide stop member having an inner face in sealing relationship with said rotors, said slide stop member having a front face, the slide stop front face being adapted to engage the slide valve member rear face to form a continuous composite member which is selectively operative to close the axially extending recess to the inlet opening, said slide member and slide stop being movable apart to provide an opening therebetween of variable selected size and axial position in communication with the inlet opening, the improvement comprising first means sensing the pressure at the discharge opening, second means sensing the pressure at the inlet opening, third means sensing the position of said slide stop member, fourth means sensing the position of said slide valve member, and means responsive to said first, second, third and fourth sensing means for controlling the movement of said stop member and said slide valve member.

2. The invention of claim 1 in which said movement controlling means comprises pressure sensor means responsive to the first and second means and operative to deliver electrical outputs proportional thereto, electric circuit means responsive to said third and fourth means and operative to deliver electrical outputs proportional thereto, and electric calculator means connected to the outputs of said first, second, third and fourth means and operative in response thereto to control the movement of said slide stop member and said slide valve member.

3. The invention of claim 1 in which said third and fourth sensing means comprise potentiometers.

4. The invention of claim 2 in which each pressure sensor means is a pressure transducer and in which each electric circuit means is a voltage divider network and in which the transducers and the voltage divider network outputs are delivered to an analog input.

5. The invention of claim 4 in which the analog input is connected to a microcomputer, said microcomputer being programmed in accordance with predetermined parameters and operative to control the movement of said slide stop member and said slide valve member.

6. The invention of claim 5 in which the movement of said slide valve is controlled in response to the electrical output from the pressure sensor means which is responsive to said second means sensing the pressure at the inlet opening.

7. The invention of claim 5, in which the movement of said slide stop is controlled in response to the electrical outputs from said pressure sensor means which are responsive to said first and second means sensing the pressures at the discharge and the inlet openings.

8. The invention of claim 7 in which said microcomputer is programmed to determine whether potentially overlapping positions exist between said slide valve member and said slide stop and is operative to temporarily relocate said slide valve member to avoid such overlapping if such condition exists.

9. The invention of claim 5 in which said screw compressor is driven by an electric motor, means sensing the current to said electric motor, means operative to deliver an electrical output proportional to said sensed current to said analog input, said microcomputer being programmed to control the movement of said slide valve to keep the current to said compressor motor from exceeding a predetermined limit.

10. The invention of claim 5, said slide stop member being connected to a first piston means, said slide valve member being connected to a second piston means, said first and second piston means being movable along the same axis and within individual isolated chamber means, means for introducing and for removing fluid into and from said chamber means on each side of said pistons for controlling the movement thereof, said means for introducing fluid comprising a source of oil pressure, said means for removing fluid comprising oil vent means connected to the compressor inlet, and solenoid controlled valve means controlling the means for introducing fluid and the means for removing fluid, and said microcomputer having an output connected to each of said solenoid controlled valve means.

* * * * *